US005105671A

United States Patent [19]

Slater

[11] Patent Number: 5,105,671

[45] Date of Patent: Apr. 21, 1992

[54] WELL PUMPING UNIT WITH ADJUSTABLE BALANCE BEAM

[76] Inventor: Frank W. Slater, P.O. Box 186, Durant, Okla. 53199

[21] Appl. No.: 671,463

[22] Filed: Mar. 19, 1991

[51] Int. Cl.[5] ..... F04B 47/02

[52] U.S. Cl. ..... 74/41; 417/411

[58] Field of Search ..... 74/41; 417/411, 415

[56] References Cited

U.S. PATENT DOCUMENTS

| | | | |
|---|---|---|---|
| 4,487,061 | 12/1984 | McTamaney et al. | 74/41 X |
| 4,502,343 | 3/1985 | Dingfelder | 74/41 |
| 4,572,012 | 2/1986 | Laney | 74/41 |
| 4,586,879 | 5/1986 | Slater | 74/41 X |
| 4,603,592 | 8/1986 | Siebold et al. | 74/41 |
| 4,631,970 | 12/1986 | Pauls | 74/41 X |
| 4,788,873 | 12/1988 | Laney | 74/41 |

*Primary Examiner*—Leslie A. Braun
*Assistant Examiner*—William O. Trousdell
*Attorney, Agent, or Firm*—Fleit, Jacobson, Cohn, Price, Holman & Stern

[57] ABSTRACT

A well pumping unit utilizing a walking beam that is longitudinally adjustable in length in order to vary the ratio of the length between the fulcrum point of the beam and the end of the beam connected with a pump rod as compared to the length of the beam between the pivot point and the point at which force is applied to the beam to oscillate it about the pivot point. By telescopically adjusting the walking beam and at the same time moving the power unit connected with the walking beam, the beam can be balanced to enable minimum energy to be applied to the beam to operate a downhole pump. The length of the connecting rod which connects a rotating eccentric powered by a power unit to the walking beam is adjustable in length to compensate for variations in movement of the pump rod resulting from longitudinal adjustment of the beam. The use of the unique features of this invention enables the horsepower requirements of a pump jack to be materially reduced with this invention inquiring a smaller electric motor or other power unit such as a one hoursepower unit as compared to a 3 to 5 horsepower unit normally employed on a pump jack.

7 Claims, 2 Drawing Sheets

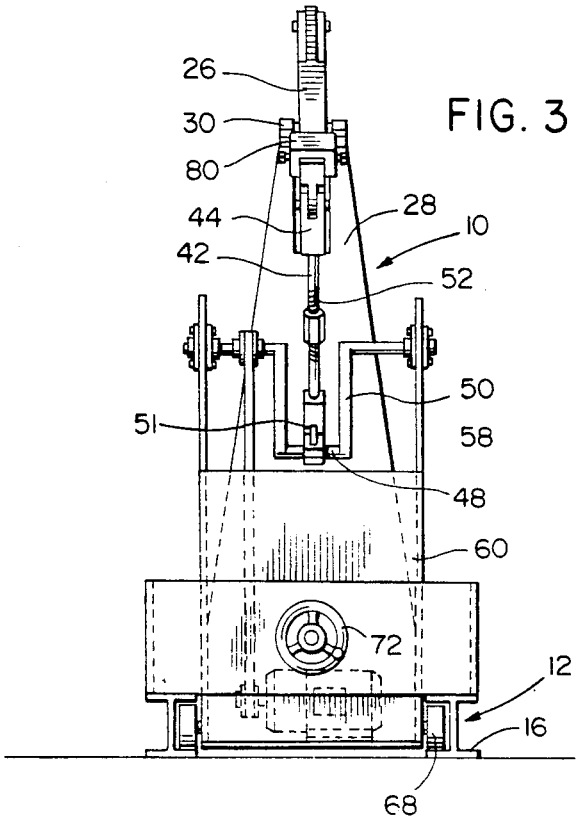
FIG. 3
FIG. 5
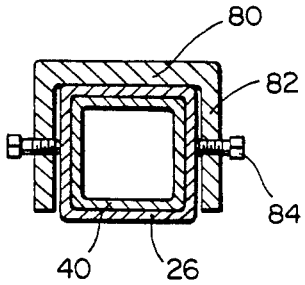
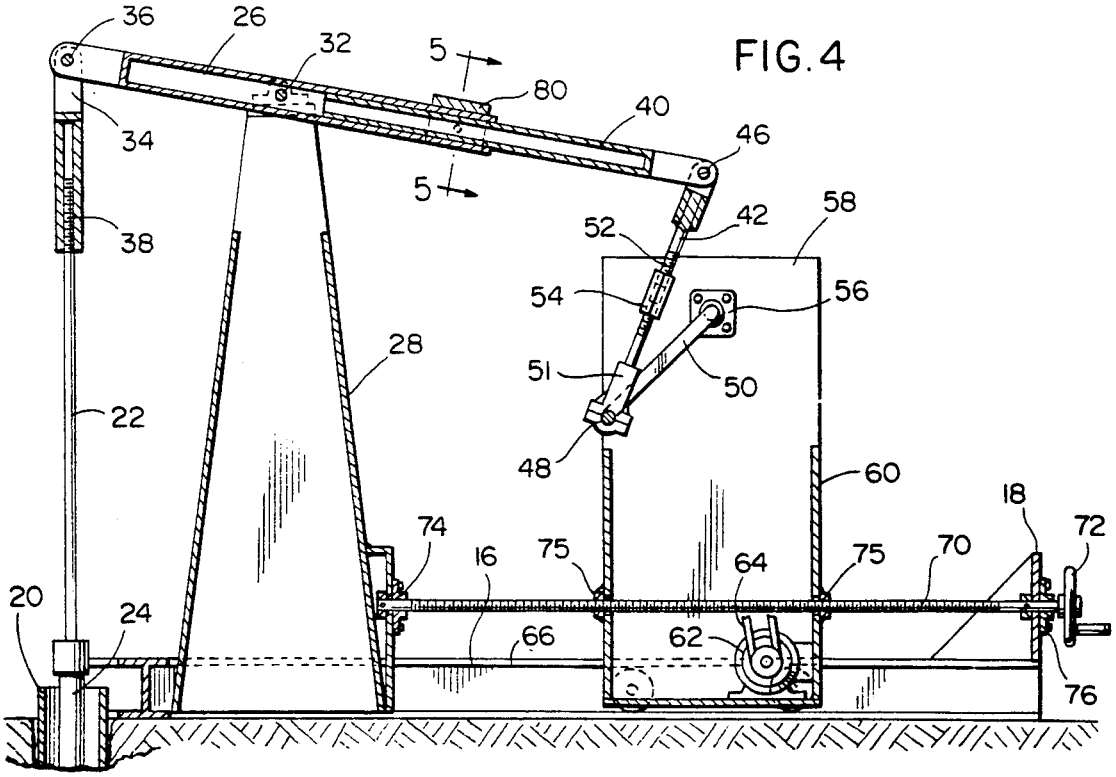
FIG. 4

WELL PUMPING UNIT WITH ADJUSTABLE BALANCE BEAM

BACKGROUND OF THE INVENTION

1. Field of the Invention

The present invention generally relates to a well pumping unit utilizing a walking beam that is longitudinally adjustable in length in order to vary the ratio of the length between the fulcrum point of the beam and the end of the beam connected with a pump rod as compared to the length of the beam between the pivot point and the point at which force is applied to the beam to oscillate it about the pivot point. By telescopically adjusting the walking beam and at the same time moving the power unit connected with the walking beam, the beam can be balanced to enable minimum energy to be applied to the beam to operate a downhole pump. The length of the connecting rod which connects a rotating eccentric powered by a power unit to the walking beam is adjustable in length to compensate for variations in movement of the pump rod resulting from longitudinal adjustment of the beam. The use of the unique features of this invention enables the horsepower requirements of a pump jack to be materially reduced with this invention requiring a smaller electric motor or other power unit such as a one horsepower unit as compared to a 3 to 5 horsepower unit normally employed on a pump jack.

2. Description of the Prior Art

My prior U.S. Pat. No. 4,586,879 issued May 6, 1986 discloses a well pumping unit associated with a downhole pump which includes a cable structure and pulley arrangements to enable the use of a smaller power unit to operate the downhole pump. This prior patent and the other prior patents of record in that patent are incorporated herein by reference thereto. None of the prior art discloses a telescopically adjustable walking beam incorporated into a pump jack together with a movable power unit connected to the adjustable component of the walking beam through a power transfer rod of adjustable length to enable the beam to be substantially balanced with the power unit being adjustable and the connection between the power unit and the adjustable beam being adjustable as incorporated into the present invention.

SUMMARY OF INVENTION

An object of the present invention is to provide a well pumping unit in the form of a pump jack for an oil well, water well or similar well having a downhole pump actuated by vertical pump rod extending upwardly to above ground and being connected to a pump jack in a conventional manner with the pump jack including a walking beam that is longitudinally adjustable in length between the fulcrum or pivot point and the point of application of power from a power unit to pivot the walking beam about its pivot axis thereby reciprocating the pumping rod with the longitudinal adjustment enabling the ratio of the lever arms on opposite sides of the fulcrum to be varied.

Another object of the invention is to provide a well pumping unit in which the power unit is adjustable longitudinally of the walking beam along with the longitudinally adjustable segment of the walking beam with the power unit being connected to the adjustable segment of the walking beam by a connecting rod structure that is longitudinally adjustable in length to maintain or vary the stroke of the pump rod that is connected with the walking beam.

A further object of the invention is to provide a well pumping unit in accordance with the preceding objects in which the walking beam is telescopically adjustable to vary the distance between the fulcrum point and the point of application of power from the power unit with the power unit being adjustable along with the adjustable component of the walking beam thereby varying the ratio of the lever arm on one side of the fulcrum point to the lever arm on the other side of the fulcrum point.

A further object of the invention is to provide a well pumping unit having a telescopically adjustable walking beam as set forth in the preceding objects together with a relatively small, manually adjustable sliding weight on the walking beam to enable final adjustment of the balanced condition of the adjustable beam.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is an end view of the well pumping unit.

FIG. 4 is a longitudinal sectional view taking substantially upon a plane passing along section line 4—4 on FIG. 2 illustrating further structural details of the invention.

FIG. 5 is a transverse, sectional view on an enlarged scale, taken along section line 5—5 on FIG. 4 illustrating the fine tuning weight mounted on the adjustable balance beam to enable adjustment of the final balanced condition of the beam.

DESCRIPTION OF THE PREFERRED EMBODIMENT

Figure 1:
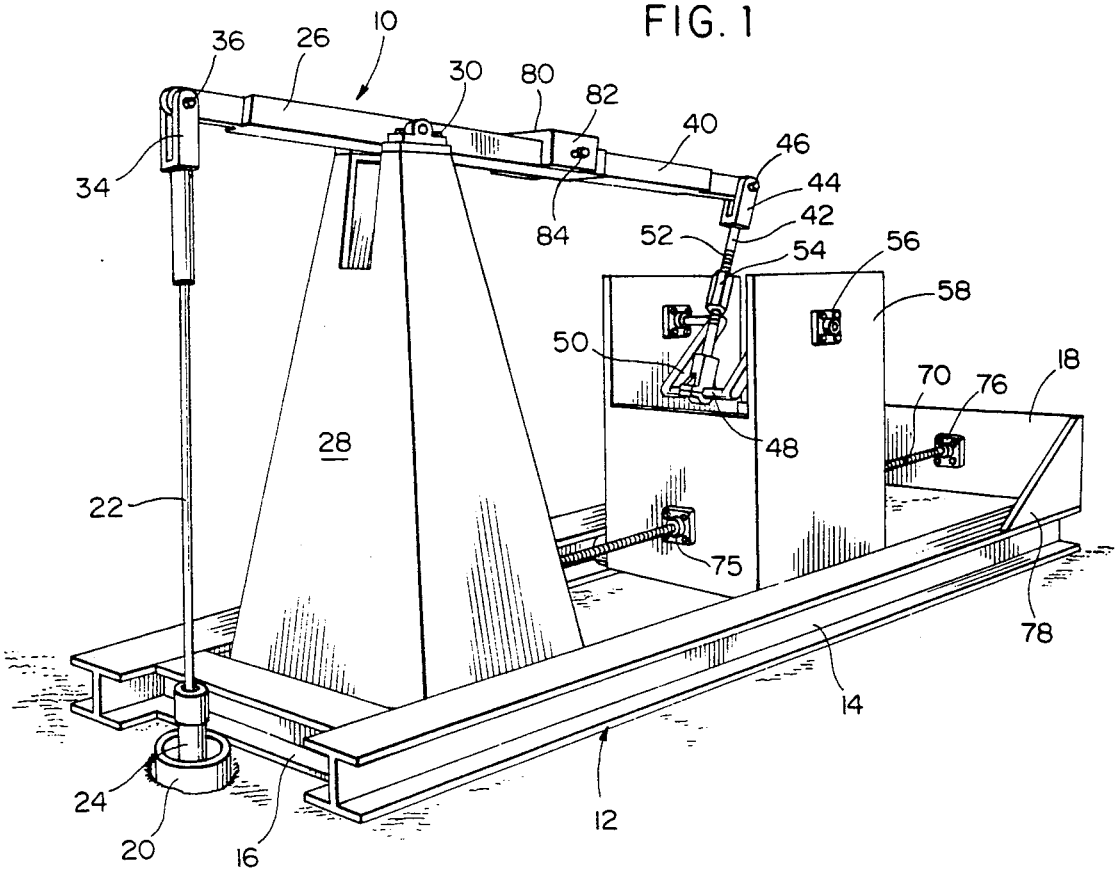
FIG. 1 is a perspective view of the well pumping unit of the present invention.
Figure 2:
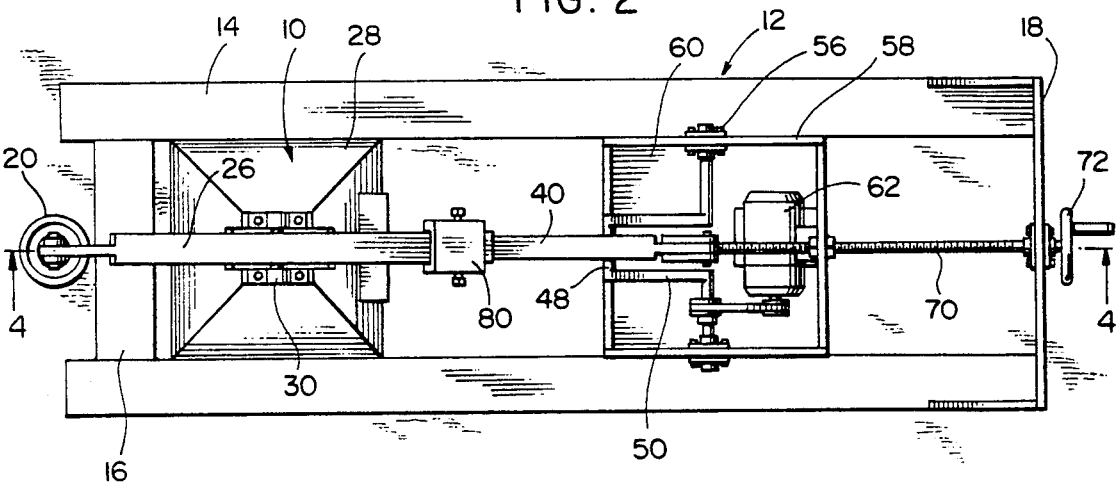
FIG. 2 is a top plan view thereof.

Referring now specifically to the drawings, the well pumping unit of the present invention is generally designated by reference numeral 10 and includes a base or skid generally designated by reference numeral 12 which includes a pair of longitudinal, parallel side rails 14 interconnected by a cross-rail 16 at one end thereof and a transversely extending vertical plate 18 at the other end thereof. The well pumping unit may be transported to a well site and supported in any suitable manner adjacent a well bore and casing 20 which receives a reciprocating pump rod 22 for producing production fluid from the well through a production pipe 24 in a manner well known in the art. The pump rod 22 operates a downhole pump not shown with the pump rod 22 having a predetermined load thereon during vertical reciprocation.

The well pumping unit includes a walking beam 26 supported from an upstanding support 28 fixed to the skid or base 14 with the support 28 taking the usual form of a samson post with bearing structures 30 at the upper end thereof supporting the walking beam 26 for pivotal movement about a fulcrum or pivot point 32.

The end of the walking beam 26 which projects into overlying relation to the well 20 is connected to the pump rod 22 by a clevis structure 34 which includes a pivot pin 36 connecting the beam to the clevis and a vertical adjustment 38 enabling an adjustment of the pump rod 22 in relation to the pivot point 36 of the beam 26.

The walking beam 26 is in the form of a hollow tubular member and the end thereof which extends from the fulcrum 32 in opposite relation to the pump rod 22 is open at the end and telescopically receives an adjustable section 40 of the walking beam to enable the effective length of the walking beam to be adjusted. The adjustable segment 40 is of hollow tubular construction closely and slidably fits within the interior of the hollow walking beam 26. The end of the adjustable segment 40 is pivotally connected to a connecting rod 42 which has a clevis 44 at its upper end to receive a pivot pin 46 pivotally interconnecting the connecting rod 42 and the end of the adjustable segment 40 of the walking beam. The other end of the connecting rod 42 is connected to an eccentric or crank 48 on a crank shaft 50 with a connecting rod bearing structure 51 providing a rotatable connection between the crank 48 and the connecting rod 42. The connecting rod 42 includes screw threaded segments 52 screw threaded into an internally threaded connector 54 by which the effective length of the connecting rod 42 can be adjusted by rotating the threaded connector 54 in a selected direction to move the threaded segments of the connecting rod toward and away from each other.

The crank shaft is mounted by bearing structures 56 supported on oppositely disposed vertical plates 58 forming part of a carriage 60 which also supports an electric motor 62 drivingly connected to the crank shaft 50 through a belt or chain drive 64 with the motor 62 being adjustable to maintain the driving connection between the electric motor 62 and the crank shaft 50 with rotation of the crank shaft 50 causing oscillation of the walking beam 26 in a manner well known in the art.

The supporting structure 60 for the electric motor or other power unit is longitudinally adjustably supported between inwardly extending flanges 66 on the rails 14 by rollers 68 with the support 60 being longitudinally adjustable on the rails 14 by the use of an elongated externally screw threaded member 70 having a hand wheel 72 on one end thereof. The inner end of the threaded shaft 70 is rotatively supported by a bearing assembly 74 supported from the support post 28 and the outer end portion of the threaded rod 70 is supported by a bearing assembly 76 on the upstanding plate 18 which is rigidified by triangular gussets 78 connecting the plate 18 to the side rails 14. Thus, the entire power unit including the connecting rod and the adjustable segment 40 may be longitudinally adjustable on the rails 14 thus varying the ratio of the length of the lever arm between fulcrum 32 and pivot point 36 to the lever arm from fulcrum 32 to pivot point 46 thereby varying the power required to operate the pump rod by balancing the forces necessary to operate the pump rod 22. The longitudinal adjustment of the connecting rod 42 compensates for variation in the ratio in order to maintain the stroke characteristics of the pump rod substantially constant.

A relatively small weight 80 on the order of 25 pounds is longitudinally slidably and adjustably locked on the beam 26 as illustrated in FIG. 5 with the weight being of inverted U-shaped configuration and provided with flanges or legs 82 straddling the beam 26 and secured in adjustable relationship on the beam 26 by set screws or bolts 84 extending through the flanges 82 and in clamping engagement with the opposite walls of the walking beam 26. This adjustable weight enables the balanced condition of the walking beam to be fine tuned by loosening the set screws or bolts 84 and sliding the adjustable weight along the walking beam 26 until optimum balance conditions of the beam 26 and the adjustable segment 40 of the beam are obtained.

The well pumping unit 10 of this invention is unique by its use of the longitudinal adjustment of the walking beam by sliding the adjustable segment 40 inwardly an outwardly thus changing the ratio of the length of the walking beam on one side of the fulcrum as compared to the other side of the fulcrum. This adjustment is simply accomplished by rotating the hand wheel 72 and the threaded shaft 70 connected thereto. The shaft is rotatably journaled in thrust bearing structures 74 and 76 thus causing the support to move longitudinally due to the threaded nuts 75 threadedly engaged with the shaft 70 and fixedly mounted to the support 60. By adjusting the power unit and the slidable segment 40 of the lever arm, the force necessary to pull the adjustable end of the walking beam down in relation to the fulcrum is substantially reduced thereby reducing the energy to operate the pump jack since the ratio may be varied from a one-to-one ratio to any ratio desired. This enables an electric motor 62 with a gear head to reduce the output to 3 rpm or some other desired speed. The horsepower may be reduced from a conventional 3 to 5 horsepower motor to a motor of ½ to 1 horsepower thereby providing a more efficient and less costly power unit for operating the pump jack. If the walking beam has a one-to-one ratio on each side of the fulcrum, one end of the beam can be adjusted to enable the downhole load to be lifted with reduced force due to the increase in the lever arm or fulcrum ratio. If weights are added to the beam to balance the downhole load, very little energy or force is necessary to operate the pump rod. The slidable weight on the beam provides fine tuning of the balanced condition of the beam which is obtained by weights added to the beam when the beam is being balanced. The added balancing weights are not illustrated but can be added to either section of the beam but preferably to the section 40.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A well pumping unit for reciprocating a pump rod extending into a well and connected to a downhole pump, said well pumping unit comprising an elongated beam, means pivotally supporting said beam for oscillation about a horizontal pivot axis adjacent a mid-point of the beam, one end of said beam being connected to the pump rod for operating the downhole pump and lifting a downhole load, a power unit connected to the other end of the beam to oscillate the beam about its pivot axis to reciprocate the pump rod, said beam including an outer component connected to the pivot axis and a telescopically oriented inner member longitudinally slidably received in the outer component to vary the ratio of the length of the beam on each side of the pivot axis, said power unit including a rotatable crank shaft having an eccentric, a motor driving said crank shaft and a longitudinally adjustable rod interconnecting the eccentric on the crank shaft with the end of the adjustable inner member of the beam to maintain or vary the stroke of the pump rod, said means pivotally supporting said beam including a support base to enable the well pumping unit to be supported at a well site, and means interconnecting the base and power unit to move the power unit along the base, said means adjusting the power unit including a threaded shaft journaled on the base and engaging a threaded nut rigid with the power unit, a hand wheel connected to the threaded shaft for rotating the threaded shaft to move the power unit along with the telescopic inner member of the beam in relation to the outer component of the beam supported from the base.

2. A well pumping unit for reciprocating a pump rod extending into a well and connected to a downhole pump, said well pumping unit comprising a supporting base, an elongated beam, means pivotally supporting said beam above said base for oscillation about a horizontal pivot axis adjacent a mid-point of the beam, one end of said beam being connected to the pump rod for operating the downhole pump, a power unit mounted on said base and connected to the other end of the beam to oscillate the beam about its pivot axis to reciprocate the pump rod, said beam including a longitudinally extending outer tubular component connected to the pivot axis and supported from the base and a longitudinally extending inner component freely telescopically slidably received in the outer tubular component to vary the length of the beam between the pivot axis and the end of the inner component, said power unit including a rotatable crank shaft having an eccentric, a motor driving said crank shaft and a rod connecting the eccentric on the crank shaft with the end of the inner component of the beam, and means interconnecting the base and power unit to move the power unit along the base toward and away from the pivot axis of the beam to vary the ratio of the length of the beam between the pivot axis and the end of the inner component to the length of the beam between the pivot axis and the connection between the outer component and the pump rod.

3. The well pumping unit as defined in claim 2 wherein said means adjusting the power unit includes a threaded shaft journaled on the base, a threaded nut rigid with the power unit, said threaded shaft being threadedly engaged with said nut, means connected to the threaded shaft for rotating the threaded shaft to move the power unit along with the inner component of the beam in relation to the outer tubular component of the beam supported from the base.

4. The well pumping unit as defined in claim 3 wherein said means connected to the threaded shaft includes a hand wheel for manually rotating said threaded shaft to move the power unit.

5. The well pumping unit as defined in claim 2 wherein said connecting rod is longitudinally adjustable to vary the length thereof for connection with the end of the inner component of the beam.

6. The well pumping unit as defined in claim 2 together with an adjustable weight on said outer component of the beam to enable the beam to be balanced with respect to a downhole pump.

7. The well pumping unit as defined in claim 2 wherein said freely telescopic inner component and the movable power unit enable the effective length of the beam to be adjusted while the power unit is oscillating the beam.

* * * * *